US011083946B2

(12) United States Patent
Johnson

(10) Patent No.: US 11,083,946 B2
(45) Date of Patent: Aug. 10, 2021

(54) MULTI-USE BALL TEE

(71) Applicant: David Johnson, Chandler, AZ (US)

(72) Inventor: David Johnson, Chandler, AZ (US)

( * ) Notice: Subject to any disclaimer, the term of this patent is extended or adjusted under 35 U.S.C. 154(b) by 0 days.

(21) Appl. No.: 16/855,461

(22) Filed: Apr. 22, 2020

(65) Prior Publication Data

US 2020/0330843 A1 Oct. 22, 2020

Related U.S. Application Data

(60) Provisional application No. 62/836,715, filed on Apr. 21, 2019.

(51) Int. Cl.
*A63B 57/00* (2015.01)
*A63B 69/00* (2006.01)

(52) U.S. Cl.
CPC ..... *A63B 69/0075* (2013.01)

(58) Field of Classification Search
CPC ..... A63B 69/0075; A63B 2209/00; A63B 2225/09; A63B 2225/605; A63B 71/03; A63B 2071/0694; A63B 2225/093
USPC ..... 473/396, 398, 401, 403, 417
See application file for complete search history.

(56) References Cited

U.S. PATENT DOCUMENTS 1,738,596 A * 12/1929 Mcleod ..... A63B 57/13 473/391
1,846,407 A * 2/1932 Thompson ..... A63B 57/13 473/391
2,159,893 A * 5/1939 Hansen ..... A63B 57/10 473/393
2,693,358 A * 11/1954 Dawson, Jr. ..... A63B 57/10 473/398
3,516,664 A * 6/1970 Brennan ..... A63B 57/10 473/278
3,671,036 A * 6/1972 Rubino ..... A63B 57/0037 473/386
6,110,060 A * 8/2000 Spoto ..... A63B 57/10 473/396
6,328,663 B1 * 12/2001 Lipstock ..... A63B 69/3661 473/396
6,849,008 B1 * 2/2005 Wang ..... A63B 57/10 473/401
7,815,529 B2 * 10/2010 Lee ..... A63B 57/15 473/398
7,901,303 B2 * 3/2011 Toyosawa ..... A63B 57/10 473/387
2005/0130769 A1 * 6/2005 Olsen ..... A63B 57/10 473/387

* cited by examiner

*Primary Examiner* — Nini F Legesse
(74) *Attorney, Agent, or Firm* — Culhane Meadows PLLC

(57) ABSTRACT

This invention is directed to a ball tee for supporting a ball. A ball tee comprises a column, and two platforms. The column is hollow and is generally identical on top and bottom, and dimensioned, at the bottom, to receive the narrow end of one platform, and, at the top, to receive the narrow end of another platform, communicating the column to both platforms, or one platform on the bottom with no platform communicated to the top, or either one platform on the top with no platform communicated to the bottom, providing a plurality of configurations and difficulty levels when utilizing the ball tee. The column is configured to stand upright on a multitude of natural and manufactured surfaces, with no platform communicated to the bottom, and to support a ball when there is no platform communicated to the top.

7 Claims, 12 Drawing Sheets

MULTI-USE BALL TEE

CROSS-REFERENCE TO RELATED APPLICATIONS

This non-provisional patent application is a continuation and claims priority benefit with regard to all common subject matter of earlier filed U.S. Provisional Patent Application No. 62/836,715, filed Apr. 21, 2019, and entitled 'Sports, fitness, and academic training system.'

BACKGROUND OF THE INVENTION

1. Field of Endeavor

Embodiments of the invention relate to sports/fitness/recreation equipment, and equipment related to physical and cognitive abilities, including the assessment of, improvement of, and rehabilitation/therapy of said abilities. More specifically, embodiments of the invention relate to a dual-sided, multi-arrangeable, multi-use ball tee from which users may pick up a ball; on which users may set down a ball; on which users may exchange a ball.

2. Prior Art

Athletes and fitness participants often rely on equipment to assess or enhance performance, or as necessary components of certain sports or activities. Tees are used as integral parts of certain sports and provide a platform from which a ball may be struck, either by another piece of equipment such as a golf club, bat, or a part of the human body, such as a foot kicking a ball off a tee. These tees hold balls in an elevated position, allowing users to strike the ball from a more advantageous, if not ideal, position, and, in many instances, decreases the likelihood the striking equipment or striking body part, will strike the surface on which a tee may rest. Striking the surface before striking the ball, or striking the surface while simultaneously striking the ball, causes a significant dissipation of power generated by the strike, thus decreasing the distance the ball will travel before coming to rest again, or being received by another person, or reaching its intended target. In other usages, tees hold a ball stationary, allowing users to practice the complex mechanics of swinging, which will then be employed to improve their ability to swing at and strike a moving target. In this usage of tees, tees are only for practice, and are not used during participation of the sport for which the striking practice was necessary. To achieve a desired position, most tees may be adjusted upward or downward either within the ball tee structure itself or by pushing the tee farther into the surface in which it is inserted, or pulling it farther out of the surface in which it is inserted. Therefore, the ball tee is essential equipment for teaching, improving, and participating in a variety of sports and activities.

However, ball tees of prior art present several hindrances and limitations. First, the ball tees are designed to hold a ball for the sole purpose of users striking a ball, which renders them one-dimensional and restrictive. Second, most ball tees of prior art are adjustable only in height but not in difficulty. Third, ball tees of prior art are sport specific, meant only for improvement in, or execution of, certain sports. Fourth, ball tees or prior art are always to be used by a single person at a time, limiting participation of others until one person is finished practicing or relinquishes the tee. Fifth, ball tees of prior art are designed to assess, improve or assist with physical acts, neglecting cognitive and neurocognitive assessments, improvements, stimulation, and achievements. Sixth, tees of prior art, by the nature of their purpose, will be struck repeatedly, thus shortening the life of the tee. Seventh, tees of prior art are only actionable on one end—one end of the tee provides a holder for a ball, and the other end provides a stabilizing base.

BRIEF SUMMARY OF THE INVENTION

The invention is defined by the claims.

Embodiments of the invention solve the above-mentioned problems and provide marked advance in the art by providing an improved ball tee. The ball tee does not only serve as a launch point for a ball, said ball tee is designed to have a participant skillfully use their hands and fingers to either place a ball onto, remove a ball from, or exchange a ball at the upper most point of the ball tee, without knocking over the ball tee or having the ball fall from the ball tee. That is the skill of usage. The ball tee may also be arranged to adjust its height and width, not for the purpose of catering to the height of the user, but rather to increase or decrease its stability on the surface on which said tee rests, and/or increase or decrease the area of the ball tee on which the ball rests, thus increasing or decreasing the level of difficulty of use. The ball tee may also be used for improvements in skills required in a multitude of sports or as equipment for individual or group fitness training, and may also be utilized in a competition-like manner, as the foundation of new, unique sport, The ball tee also may be utilized with a single user or multiple users, providing the opportunity for more than one person to simultaneously reap benefits from its usage. The ball tee may also be utilized to perform and improve a multitude of physical, athletic, and cognitive actions, skills and processes, including but not limited to, power, speed, balance, agility, hand-eye coordination, memory, dexterity, gross and fine motor skills, critical thinking, pattern recognition, sequencing, and more. When using the ball tee, there is no objective to strike at said tee or a ball resting upon said tee, or subject it to any significant impact, thus greatly reducing the opportunity for the ball tee to sustain damage, particularly catastrophic damage. The ball tee may be utilized on either end, according to how it is erected and configured. In most configurations, if the ball tee is knocked over, it may be quickly erected with either side up or down. Said ball tee may be arranged in four different configurations constituting four different levels of difficulty. In all four configurations of the ball tee, a ball may be place on, removed from, or exchanged at its upper most end.

A first embodiment of the invention may provide a tee for supporting a ball. The ball tee includes a column and two platforms. The column is generally cylindrical, hollow, and with an aperture at each end, allowing a continuous unobstructed view through one end to and through the other end. Said column is identical on top and bottom and dimensioned, at the bottom, to receive the narrow end of one platform, and, at the top, to receive the narrow end of another platform, communicating the column with a platform at the top of said column and a platform at the bottom of said column, or either a platform at the top of said column with no platform at the bottom, or a platform at the bottom of said column with no platform at the top, providing a plurality of difficulty levels when utilizing said tee. Said column is configured to stand upright, on a multitude of natural and manufactured surfaces, without a platform attached to the bottom, and to support a ball when a platform is not attached to the top. Said column is narrower than the wide end of each platform and is less stable on said surfaces than when a platform is attached to bottom of said column, and provides less support for a ball than when a platform is attached to top of said column. A platform is disposed at the bottom of the ball tee, below the column, and configured to fit partially within said column. Said platform is hollow with an aperture at each end, allowing a continuous unobstructed view through one end to and through the other end. Said platform presents a generally funnel-like shape, of which the narrow end of the funnel shape is extended and flattened, and is configured to fit within said column, communicating the platform with the column. The wide end of said platform is wider than the column, faces downward and interfaces with a multitude of natural and manufactured surfaces, providing greater stability to the ball tee than when platform is not attached. A platform may be disposed atop the ball tee, above the column, and configured to fit partially within said column. Said platform is hollow with an aperture at each end, allowing a continuous unobstructed view through one end to and through the other end. Said platform presents a generally funnel-like shape, of which the narrow end of the funnel shape is extended and flattened, and is configured to fit within said column, communicating the platform with the column. The wide end of said platform is wider than the column and is oriented upward to support a ball, providing greater stability for a ball than when platform is not attached to the column. The ball tee, at any level of assembly, has an aperture at the top and bottom, allowing a continuous unobstructed view through one end to and through the other end.

Another embodiment of the invention may provide a column for supporting a ball and for receiving a platform at the top and a platform at the bottom. The column is generally cylindrical with an aperture at each end, allowing a continuous unobstructed view through one end to and through the other end. Said column is identical at its top and bottom ends. Said column is dimensioned, at the bottom, to receive the narrow end of a platform, and, at the top, to receive the narrow end of a platform, communicating the column with a platform at the top, and a platform at the bottom, or a platform at the top with no platform at the bottom, or a platform at the bottom with no platform at the top, or no platform at either end. Said column is configured to stand upright, on a multitude of natural and manufactured surfaces, without a platform attached to its lowermost end, and is less stable on said surfaces than when a platform is attached. Said column is configured to support a ball when no platform is attached to its uppermost end, and is narrower than the wide end of the platform, providing less support for a ball than when a platform is attached.

Another embodiment of the invention may provide a platform at the bottom of the ball tee for greater stabilization of the ball tee, wherein the ball tee is configured to support a ball. Said platform is disposed at the bottom of said tee, below the column, when ball tee is erected in an upright position, and configured to fit partially within said column. Said platform is hollow with an aperture at each end, allowing a continuous unobstructed view through one end to and through the other end. Said platform presents a generally funnel-like shape, of which the narrow end of the funnel shape is extended and flattened, and is configured to fit within said column, communicating the platform with the column. The wide end of said platform is wider than said column. The wide end of said platform is oriented downward and interfaces with a multitude of natural and manufactured surfaces, providing greater stability to the ball tee than when said platform is not attached.

Another embodiment of the invention may provide a platform at the top of the ball tee for greater stabilization of a ball, wherein the ball tee is configured to support a ball. The platform is disposed atop said tee, above the column, when tee is erected in an upright position, and configured to fit partially within said column. Said platform is hollow with an aperture at each end, allowing a continuous unobstructed view through one end to and through the other end. Said platform presents a generally funnel-like shape, of which the narrow end of the funnel shape is extended and flattened, and is configured to fit within said column, communicating the platform with the column. The wide end of said platform is wider than the column. The wide end of said platform is oriented upward to support a ball, providing greater stability for a ball than when platform is not attached to the column.

Another embodiment of the invention may provide a column and two platforms, allowing the exact same configurations as mentioned in the previously mentioned embodiments of the invention, wherein there is an addition of an external stabilizing ring protruding from the column and traveling 360° around the column, which has a circumference greater than the circumference of the column.

Another embodiment of the invention may provide a column and two platforms allowing the exact same configurations as mentioned in the previously mentioned embodiments of the invention, wherein there is an addition of several wind vents in the column.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWINGS

Examples of the invention will now be described in detail with reference to the accompanying drawings, in which.

DETAILED DESCRIPTION OF THE INVENTION

Figure 1:
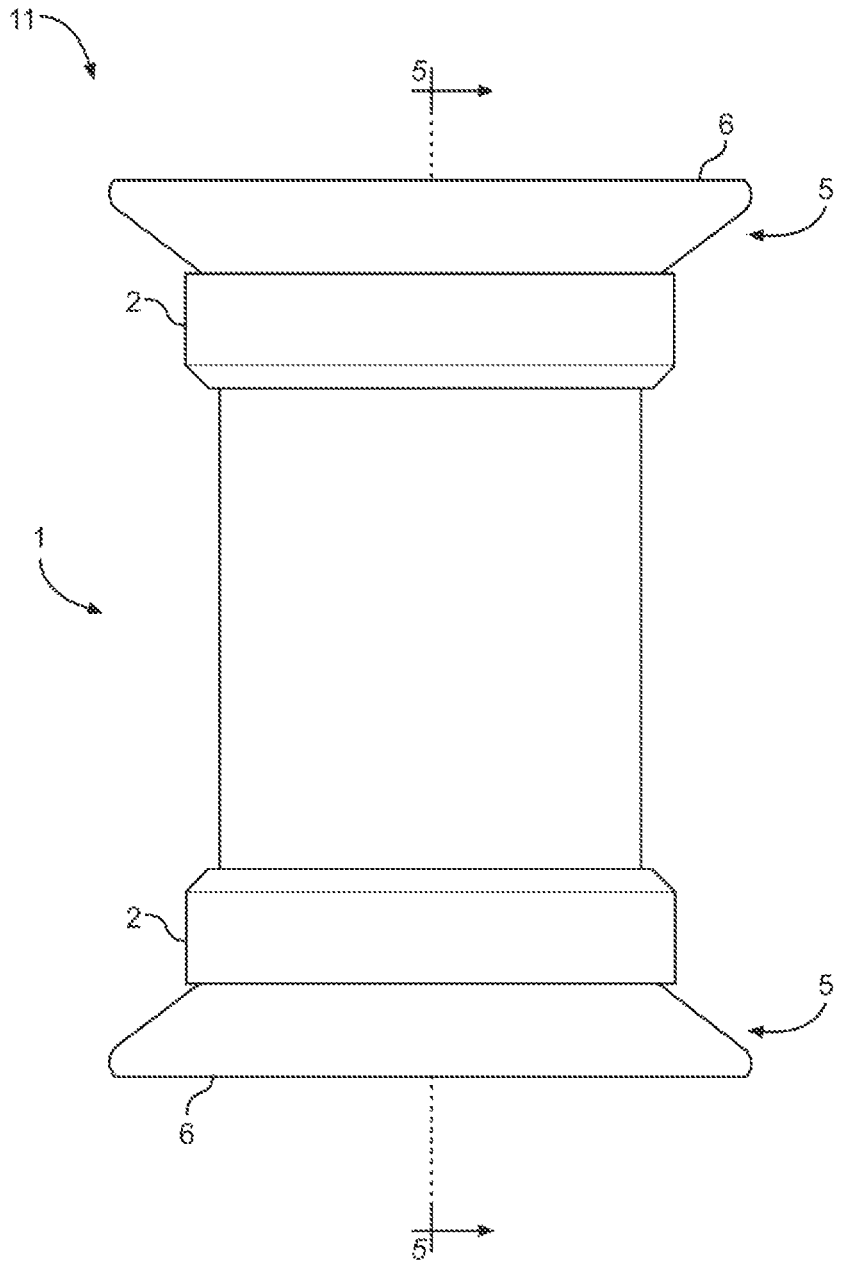
FIG. 1 is a view from the front, back, or side of one embodiment of the ball tee.

It should be understood that the Figures are merely schematic and are not drawn to scale. It should also be understood that the same reference numerals are used throughout the Figures to indicate the same parts.

As best depicted in FIG. 1, a ball tee 11 of embodiments of the invention comprises a column 1, and two platforms 5, one platform 5 serving as a ball holder, the other platform 5 serving as a base. The platforms 5 are inserted into the narrow end receiving docks 2 on either end of the column 1. The platform 5 sitting atop the ball tee 11 serves as a ball holder, the platform 5 at the bottom of the ball tee 11 serves as the base. The bottom platform 5 interfaces with a multitude of natural and manufactured surfaces. One platform 5, top or bottom, or both platforms 5 may be removed to decrease stability of the ball tee, thus increasing difficulty of use, to make utilizing the ball tee more challenging.

To benefit the reader, a discussion of the field of use of the present invention will be provided before proceeding with the in-depth discussion of the components of the ball tee 11. In the execution of most sports or athletics endeavors, there are fundamental physical elements required to perform them. Among these elements are speed, agility, quickness, strength, power, balance, proprioception, endurance, and a multitude of others. The foundation of many of these elements is the ability of an athletic participant to lower their center of gravity prior to or during the execution of an athletic maneuver. This ability to lowers one's center of gravity is often based on their degree of knee flexion, which is commonly referred to as knee bend—the process of lowering one's self, with initiation of the lowering caused by a bending at the knees to more resemble squatting down, as opposed to bending over, which is initiated by a bending at the waist with minimal bending of the knees. A lower center of gravity, with bent knees and with adequate body-weight distribution, is often referred to as an athletic stance because it is the ideal starting stance, or position, from which to execute a multitude of athletic movements and maneuvers, and serves as the foundation for the fundamental athletic elements mentioned previously in this section. As an athletic participant lowers their center of gravity, potential energy is created in their muscles. When an athlete then extends to return from the knee bend, the potential energy is then converted to kinetic energy, allowing the athlete to perform an athletic maneuver, such as jumping, running, throwing, hitting, shuffling, tackling, pushing, pulling, lifting, changing directions, and multitude of other athletic actions. Bending one's knees to create potential energy is similar to an archer drawing back his bow. When the bow is drawn back, waiting to be released, it is storing potential energy. When the bow is released, motion is created, and the potential energy is converted to kinetic energy, causing the arrow to be ejected with great speed. This potential-energy to kinetic-energy conversion, when performed by athletes, may take a few seconds or a few fractions of a second. When athletes convert potential energy to kinetic energy, they generate greater athletic power, which may then translate into greater speed, jumping ability, quickness, stability, production of force, and a multitude of other desirable sports-performance measures. The greatest level of power is produced when an athlete lowers their center of gravity as much as possible (potential energy) and transitions to an athletic maneuver as quickly as possible (kinetic energy). Generally, degree of knee bend×rate of transition=Power. Successfully achieving or maintaining an athletic stance prior to, or during, a definitive athletic movement, allows for a greater chance of success in most athletic endeavors. Football, basketball, baseball/softball, soccer, tennis, hockey, volleyball, lacrosse, gymnastics, cheerleading, and a multitude of other sports and activities, require the successful execution of the rapid knee-bend-to-athletic-maneuver transition. It is virtually impossible to perform an athletic movement or maneuver using your lower body without the bending of one or both the knees. Before the start of every football play, players bend their knees to ready themselves. Before two basketball players jump to fight for a ball, they bend their knees to create potential energy. Before a baseball player hits a ball and before a fielder fields a ball, each must bend their knees to accomplish the feat. When a soccer striker maneuvers down the field with the ball, when a defender defends the striker, and when the goalie attempts to block a goal attempt, they must all bend their knees to generate power, speed, maintain balance, and to execute a change of direction.

Although an acceptable athletic stance is critical in a multitude of sports endeavors, it is difficult to achieve and maintain. The incessant demand from coaches to their players to 'get low' and/or 'stay low,' is one of the most common demands in the sports and fitness world, and must be repeated often because it is not a natural stance. Plus, when an athlete becomes tired during training or during competition, getting low and staying low becomes ever more difficult. Bending one's knees repeatedly, and holding an athletic stance requires a great deal of energy, leg strength, and endurance. It then takes even more energy to perform an athletic maneuver from that stance or initiate an athletic movement from that stance. Embodiments of the invention are useful in helping an athlete achieve and/or maintain the requisite knee bend to perform athletic maneuvers. Although there is no standard height for the ball tee, many embodiments of the ball tee are merely a few inches tall, from the bottom of the base to the top of the ball holder. With this height, the ball tee 11 naturally brings athletes low to the ground, allowing athletes to complete a significant number of exaggerated knee bends during a training session. The repetitive exaggerated knee bends performed during the conditioning or practice phase of athletics, facilitates the requisite knee bend for competition. The practice of training with an additional or exaggerated movement or force is common throughout the sports world. Football players train by pushing or pulling cars and other vehicles. This, in turn, makes the act of pushing or pulling an opposing player much easier. Basketball players train with weighted vests to increase jumping power and improve jumping ability, and they train with heavier-than-normal basketballs to increase long-distance shooting ability. Baseball players train by swinging a heavier bat or adding weighted rings to their bats while practicing their swings, to improve bat speed and power. Embodiments of the ball tee 11 are useful in helping users repeatedly perform exaggerated knee bends during training, to make requisite knee bends more achievable during competition.

Another significant element of sports is cognition and cognitive competence. When an athlete enters a game or competition, they are now on their own, even if they are competing in a team sport. In most sports, coaches and teammates may offer advice and instruction before, during, and after a competition, but no one can think, rationalize, and make decisions for an athlete in the moment—in the split second an athlete must think, recall a scenario that's been predicted and practiced, make a critical decision, and then act on that decision by translating it into an athletic action. This is a critical component of nearly every sport. During the process of sports and fitness conditioning and sports-skills training, cognition and fine motor skills are rarely, if ever, addressed as matters of importance. Participants engaged in this realm of conditioning and training, focus so diligently on training the body, they rarely train the brain for the purpose of enhancing cognition. Training the brain, unless training the mind for endurance, attrition, or to endure pain, is not considered a necessary component of sports and fitness conditioning. The brain is usually trained in the classrooms (or meeting rooms/film rooms for athletes), and it is usually sport-specific training—training to master the sport in which an athlete is competing. Athletes learn and master their playbooks and then apply it on the fields and courts during practice sessions. Cognition, as a skill, is rarely, if ever, addressed in the conditioning phase of athletic preparation, a phase which accounts for innumerable hours of an athlete's preparation. In fact, an entire industry has emerged to distract athletes and fitness participants from the rigors of their physical workouts. Video screens, music players, books, magazines, and various other forms of entertainment are often used to provide these distractions, to encourage athletes to zone out during workouts. Most often, these distractions are disparate from the physical activity in which the athlete or fitness participant is involved. Even when the distraction is tangentially related to the physical activity, it primarily involves an instructor or coach delivering orders to change the mode, pace, or intensity of an exercise. Embodiments of the invention are useful for developing and enhancing a multitude of fundamental athletic elements, simultaneously or individually, across a broad spectrum of sports, fitness, and conditioning endeavors, while providing a distraction from the rigors of the activity, but keeping the user cognitively focused so they may complete a task, as would be required of them during a sports competition. The ball tee 11 can be used by an individual athlete training by themselves, or by multiple users, teams, and groups. The ball tee 11 is adapted to be utilized on a multitude of natural surfaces, including but not limited to, grass, sand, snow, dirt, wood, rubber, etc., and various manufactured surfaces, including but not limited to, wood flooring, vinyl flooring, rubber flooring, plastic flooring, artificial turf, synthetic grass, carpet, tile, asphalt, cement, plastic agility cones, etc.) The ball tee 11 may also be placed on a flotation device and floated on water.

Generally, the ball tee 11 will be utilized in the following manner to seamlessly blend physical and cardiovascular conditioning, with cognitive conditioning, as well as conditioning of a user's fine motor skills. The ball tee 11 is used as a target to prompt participants to move to the ball tee 11 then skillfully place upon, remove from, or exchange balls on the ball tees, without having the balls fall from the ball tee or causing the ball tee to topple. These actions are executed while user or users locomote—run(s) and/or walk(s), and/or squat(s), and/or shuffle(s), and/or jump(s), and/or hop(s), and/or sits up, and/or crawl(s), and/or skip(s), and/or roll(s), and/or lunge(s), and/or drag(s), and/or climb(s), and/or plank(s), and/or scoot(s), and/or ski(s), and/or swim(s), and/or ride(s), and/or is carried, and/or reach(es), etc.—to and from the ball tees 11 for the development and/or enhancement of a person's or persons' motor skills, sports performance, general athleticism and physical conditioning, including but not limited to speed, quickness, strength, power, hand-eye coordination, dexterity, balance, cardiovascular endurance, weight loss, and proprioception, as well as cognitive skills, including but not limited to, thinking, learning, memorizing, reasoning, focusing, adroitness and mental processing (pattern recognition, sequencing, predicting, etc.). From this point forth in this document, regarding the use of the ball tee 11, locomote* or locomotes* will denote a multitude of actions or movements users may employ when utilizing the ball tee 11. The actions and movements denoted by locomote* or locomotes* include, but are not limited to: running, walking, squatting, shuffling, jumping, hopping, sitting up, crawling, skipping, rolling, lunging, dragging, climbing, planking, scooting, skiing, swimming, riding, reaching, carrying or being carried, and other actions.

Instructions for utilization of the ball tee 11 for sports and fitness endeavors will follow.

For basic use of the ball tee 11, those familiar with sports and fitness conditioning will find familiarity with the basic drill performed using the ball tee 11. This basic drill is an enhanced version of the standard 'suicide drill' performed around the world by nearly every sports team, at every level, as well as fitness participants of every strife. The version of the drill using the ball tee 11, provides a pragmatic demonstration of the differences, benefits, and advantages of utilizing the ball tee 11 for athletic training. For purposes of this example, the drill will be described with the ball tee 11 in its base configuration, which is a column 1 with a platform 5 attached to the top end of said column 1, and a platform 5 attached to the bottom end of said column 1.

To perform this drill, a plurality of the ball tees 11 should be placed in a straight line. The number of ball tees 11 used is determined by the user's preference and the availability of ball tees 11. The ball tees 11 may be placed at any distance preferred by the user. Users will then establish a starting point where they will place balls in a bucket or any safe, stable container, or structure. The balls may also be sat directly on a level surface in manner that will not allow or cause the balls to roll away. Users will then pick up a single ball from the container, or from the surface on which it is resting, then run towards the ball tees 11. When user reaches a targeted ball tee 11, they will squat down, place a single ball on the upper most platform 5 on top of a single ball tee 11, then run back to the starting point to retrieve another ball. User will repeat the process until each ball tee 11 has a ball resting upon its upper most platform 5. Users may then retrieve the balls, one by one, from the platform 5 on top of each ball tee 11, until all balls have been returned to the starting point, or users may exchange balls on the ball tees 11 until all balls have been replaced.

For proper execution of the drill and to reap the most athletic benefits from use of the ball tee 11, when setting balls on, removing balls from, or exchanging balls on the ball tees 11, users should focus on knee bend—squatting by bending mostly at the knees rather than at the waist—feet approximately shoulder width apart, and bringing their gluteals down approximately even with their knees or lower, quadriceps approximately parallel or lower, to the surface on which they are standing. As soon as the action at the ball tee 11 has taken place, users should burst out of the squatting stance and run back to the starting point where proper knee bend should also be employed when squatting to retrieve a ball or return a ball to the container or surface from which it originated in the drill.

Dexterity of the hands, hand-eye-coordination and fine motor skills are among other significant areas of focus when utilizing embodiments of the invention. When performing an action at the ball, the object is always that the ball should be skillfully placed on, retrieved from, or exchanged on the ball tee 11 of any arrangement, without the ball falling off the ball tee 11 and without the ball tee 11 falling over. This requires ample coordination of the hands, fingers, and eyes. To further bolster the training of hands, fingers, eyes, and other motor skills, users may not always be required to pick up a ball from a designated starting point. Instead, they may have a ball thrown to them, rolled to them, bounced to them, handed to them, or they may receive a ball in a multitude of other methods.

To apply a cognitive element to the drill, users may be instructed to place the balls on the ball tees 11 in a particular order. For example, the instructions may direct the user to deliver the balls to the ball tees 11 in the order 3-1-5-2-4. The instructions may be delivered by coach, instructor, training partner, electronically, or any other method of delivery. The instructions may take the form of a vocal call out, visual read out, auditory tones or beeps, musical notes, or any other form of communication. Once the instructions are received, users will perform the drill by delivering, retrieving, or exchanging the balls at the ball tees 11 in the order given in the instructions. Regarding the previous 'suicide drill' example, the user will start at the starting point, pick up a ball, and run to the third ball tee 11 to deliver the first ball. Users will then return to the starting point, pick up another ball and then run to the first ball tee 11 to deliver the second ball. Users will continue the process until five balls have been placed on five ball tees 11 in the order instructed. Balls of varying colors may also be used in this drill. In this instance, and merely as an example of the ball tee's versatility, users may receive instruction to deliver the balls in a color sequence, i.e., red-blue-green-orange-yellow. Similar to the process involved in the previous example where users were directed to execute the drill in a numerical order, users must now deliver, retrieve, or exchange the balls in a certain color sequence. In this example, a red ball will be picked up and delivered to the first ball tee 11. Next, a blue ball will be picked up and delivered to the second ball tee 11. This process will be repeated until the green, orange, and yellow balls, are delivered to the third, fourth, and fifth tees, respectively.

The process involved in utilizing the ball tee 11 in this enhanced version of a basic drill, provides additional, and significant, athletic components to a universally performed drill that historically lacks these additional components, and normally requires athletes to merely run to a series of lines or landmarks, touch them with a hand or foot, and then run back, with no regard for cognition, or any other athletic aspect other than cardiovascular conditioning.

For advanced physical conditioning user may arrange the ball tees 11 in a manner that allows for the execution of several types of athletic movements, and for the enhancement of several skills (speed, agility, balance, strength, etc.). The ball tees 11 should be set apart at varying distances, in varying directions, and at varying levels, compelling users to accelerate, decelerate, start, stop, and start again during the drill, and also change speeds, directions, power outputs, and to employ varying types of locomotion such as running, jumping, shuffling, crawling, hopping, back pedaling etc., to reach the individual ball tees 11, where users will skillfully place a ball on, remove a ball from, or exchange a ball at the top end of the ball tee 11, achieving adequate knee bend when it is proper to do so. Users may also include other athletic training equipment to drill utilizing the ball tee 11, including but not limited to hurdles, cones, agility ladders, training vests, and a multitude of other equipment. Users may also perform a multitude of bodyweight strength moves such as pushups, or perform weight-lifting repetitions with dumbbells or other strength training equipment, before or after performing an action at the ball tee 11.

It should be understood that the field of sports is only an exemplary field of use. Other fields of use for the invention include general health and fitness improvement, academic and physical education, general recreation, physical therapy, occupational therapy, habilitation therapy, psychological therapy, behavioral therapy, military training, first responder training, and a multitude of other uses. One embodiment of the invention is directed to a neurodegenerative therapy and assessment tool. For example, the tool may generally resemble the ball tee 11 described herein with relatively larger platforms 5. One embodiment of the invention is directed to a wind and rain resistant ball tee which generally resembles the ball tee 11 described herein with a series of vents in the column 1, allowing wind and water to pass through, decreasing the likelihood the ball tee will topple when affected by those elements. One embodiment of the invention is directed to an uneven-terrain ball tee which generally resembles the ball tee 11 described herein with a column 1 possessing an external ring protruding from the column 1, and having a circumference greater than the circumference of the column 1 allowing the ball tee to be inserted into and remain upright in the aperture of an agility cone or utility cone.

The components of the ball tee 11 will now be discussed in greater detail. As previously discussed, the ball tee 11 broadly comprises the column 1 and two platforms 5. The column 1 is appreciated to be the main component of the ball tee 11 and features one narrow end receiving dock (NERD) 2 on its top end, and one narrow end receiving dock (NERD) 2 on its bottom end. The NERD's are not separate from the column 1, they are features of the column 1. When the ball tee 11 is to be utilized at its standard level (novice level), it is configured with all components—column 1 and two platform's 5—assembled into a single unit.

As best illustrated in FIG. 1, in embodiments of the invention, the standard-level configuration of the ball tee 11 comprises the column 1 erected with either side up and the other side down, a platform 5 communicated to the top end of the column 1 and a platform 5 communicated to the bottom end of the column 1. The column 1 is hollow. The platforms 5 are inserted into the narrow end receiving docks 2 on either end of the column 1. The platform 5 located at the top serves as a ball holder, the platform 5 located at the bottom serves as a base. When placed on the ball tee 11 in this configuration, a ball will rest on the wide end 6 of the top platform 5. The wide end 6 of the bottom platform 5 interfaces with ground or any other surface on which the ball tee 11 is erected. As represented in FIG. 1, It should be understood that the ball tee 11, when rotated 360°, presents the same view at every degree or rotation. In this regard, there are no obvious front, back, left, or right sides, so users may approach and utilize the ball tee 11 from any direction.

Figure 2:
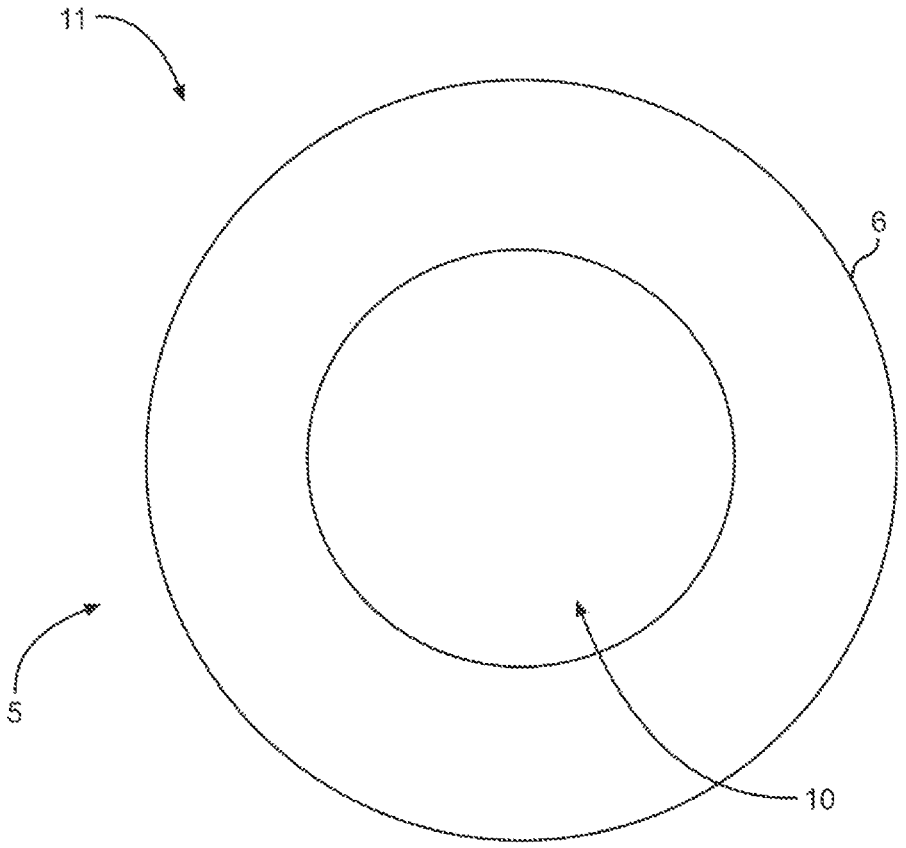
FIG. 2 is a top or bottom view of the embodiment of the ball tee from FIG. 1, generally showing a platform 5 of the ball tee, depicting a general circular shape.

FIG. 2 presents both a view from the top and a view from the bottom of the ball tee 11, and it should be appreciated that each end is dimensioned to be generally identical. Each end is randomly determined to be the top or the bottom according to if it is situated on top or bottom of the ball tee 11, when ball tee 11 is erected vertically. From this top/bottom view of FIG. 2 we can see the wide end 6 of a platform 5, and an aperture 10 which is present through its center. The apertures 10 may serve as finger holes and may contribute to the ease of transport of the ball tee 11, allowing many users to slip the ball tee 11 over their finger.

Figure 3:
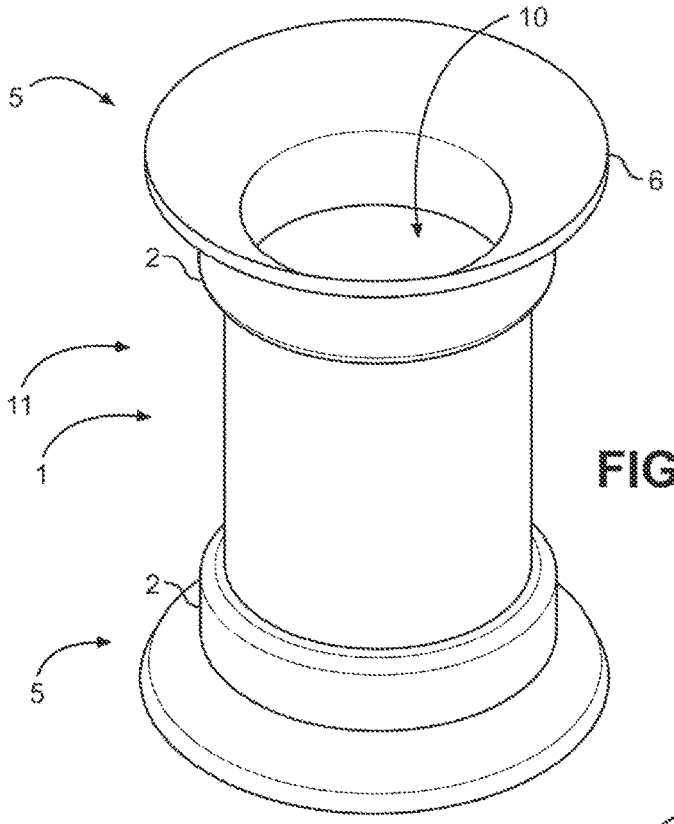
FIG. 3 is a perspective view of the embodiment of the ball tee from FIG. 1.
Figure 4:
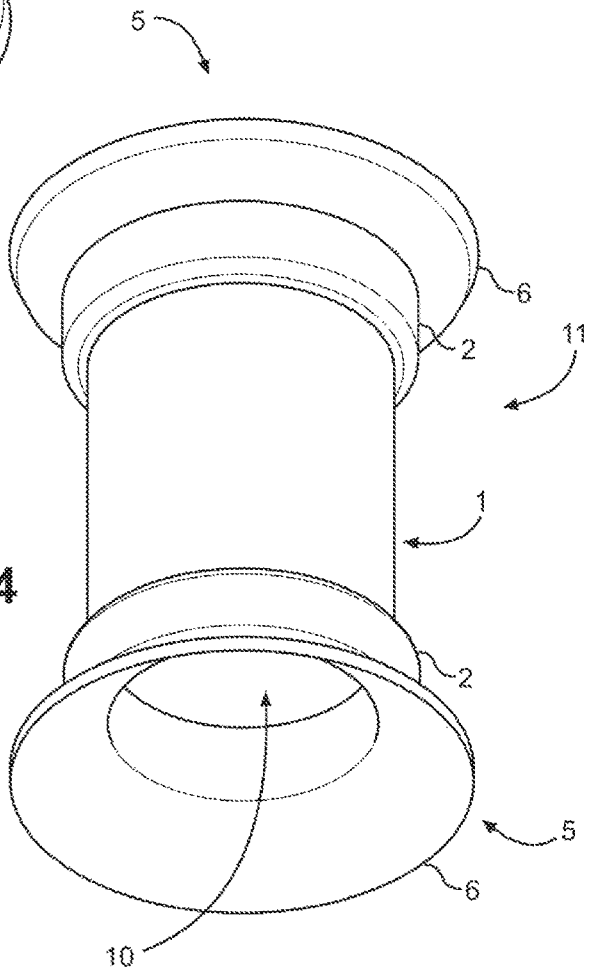
FIG. 4 is a perspective view of the embodiment of the ball tee from FIG. 1.

FIG. 3 demonstrates that, when communicated to the hollow column 1, the wide end 6 of a platform 5, when located on top of the ball tee 11, is oriented upward and slopes downward and inward presenting a general funnel-like shape and is dimensioned to hold a ball, providing greater stability to the ball than when no platform 5 is located on top end. The platforms 5 are inserted into the narrow end receiving docks 2 on either end of the column 1. FIG. 4 demonstrates that the wide end 6 of the platform 5, when located on the bottom of the ball tee 11, is oriented downward and slopes upward and inward and interfaces with the surface on which it is placed, providing greater stability to the ball tee 11 than when no platform 5 is located on the bottom. The platforms 5 are inserted into the narrow end receiving docks 2 on either end of the column 1.

Figure 5:
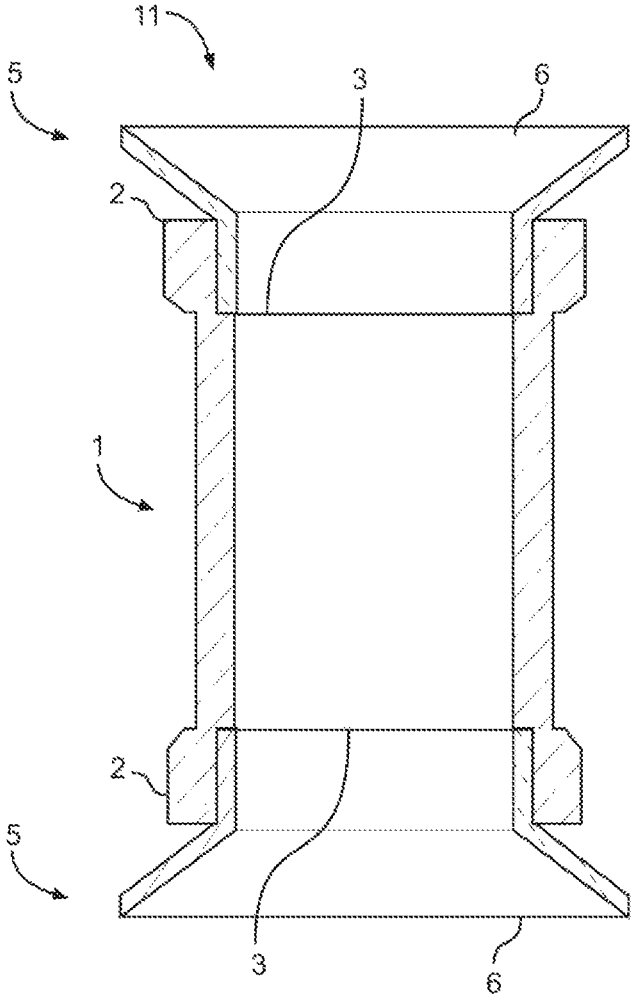
FIG. 5 is a vertical cross-section view of the embodiment of the ball tee from FIG. 1, generally from a front, back, or side angle.

In embodiments of the invention, the cross-sectional views of the ball tee 11 presented in FIG. 5 illustrate how the platform's 5 communicate to the hollow column 1. The inner wall of the narrow end receiving docks (NERD) 2 is a fraction of a millimeter wider than the narrow end 7 of the platform's 5, allowing a slidable insertion of either platform 5 into either NERD 2 until the leading edge 71 (shown in FIG. 13) of the narrow end 7 of the platform 5 contacts and rests against the narrow end receiving stop (NERS) 3. The wide end 6 of the top platform 5 is oriented upward to receive a ball, the wide end 6 of the bottom platform 5 is oriented downward to provide support on the surface on which tee is erected.

Figure 6A:
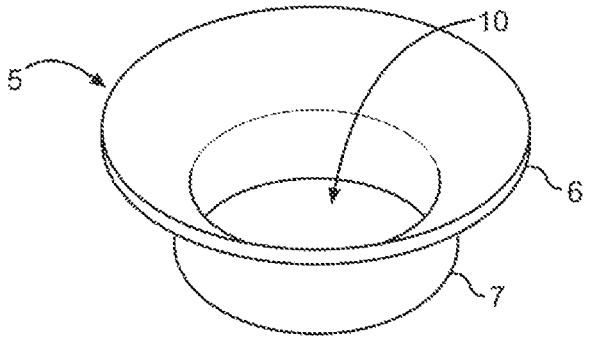
FIG. 6A, FIG. 6B, and FIG. 6C are exploded views depicting the various components of the embodiment of the ball tee from FIG. 1.
Figure 6B:
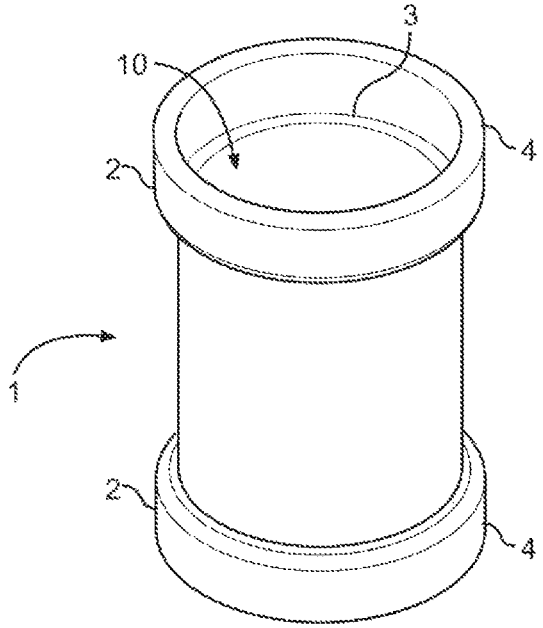
Figure 6C:
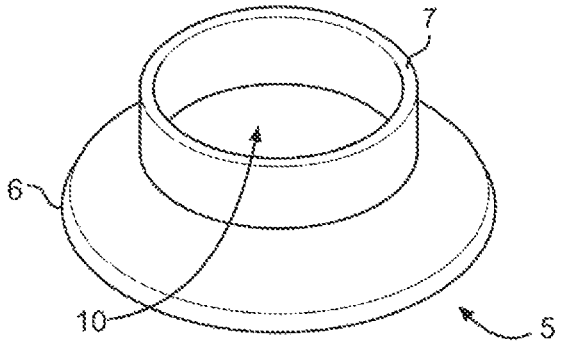

As best illustrated in FIG. 6A, FIG. 6B, and FIG. 6C, in embodiments of the invention, the components of the ball tee 11 separated from one another in a series of exploded views. The hollow column 1 is erected in a vertical position and serves as the main component to which the platform's 5 are to be communicated. In this exploded view the progressive support rings 4, located at the extreme top and bottom edges of the column 1 are exposed. The platform 5 at the top is oriented in such a way that the wide end 6 is up, and the narrow end 7 is down. When communicating the top platform 5 to the column 1, the communication is done so by inserting the narrow end 7 into the aperture 10 of the narrow end receiving dock (NERD) 2 at the top of the column 1. The platform 5 at the bottom is oriented in such a way that the wide end 6 is down, and the narrow end 7 is up. When communicating the bottom platform 5 to the column 1, the communication is done so by inserting the narrow end 7 into the aperture 10 of the narrow end receiving dock (NERD) 2 at the bottom of the column 1. The narrow end 7 of either platform 5 is inserted as far as possible into either NERD 2 until it reaches a narrow end receiving stop (NERS) 3 located on the inner wall of the column 1.

As best illustrated in FIGS. 7, 8, 10, and 11, in embodiments of the invention, the hollow column 1 of the ball tee 11 is generally cylindrical. At each end of the column 1 there is a narrow end receiving dock (NERD) 2, which is slightly wider than the rest of the column. In the vertical center of the column 1 there is an aperture 10 in which the narrow ends of platforms may be inserted far enough to reach the narrow end receiving stops 3. FIGS. 7, 8, 9, 10, 11 present the progressive support rings (PSR) 4 inherent in the hollow column. The PSR's 4 serve as the ball holder (top) and the base (bottom) when column 1 is being utilized as an advanced-level ball tee 11, with no platforms communicated to the column 1. In this embodiment of the invention, which is the most difficult to utilize, the PSR 4 has a smaller radius than a platform so it presents a greater challenge to users when no platform is communicated to the column 1. At the top end, the smaller radius of the PSR 4 increases the difficulty by increasing the likelihood the ball will fall from the ball tee when user attempts to place a ball on, remove a ball from, or exchange a ball on the ball tee 11. At the bottom end, the smaller radius of the PSR 4 increases the difficulty by increasing the likelihood the ball tee 11 will fall over when user attempts to place a ball on, remove a ball from, or exchange a ball on the ball tee 11.

Figure 9:
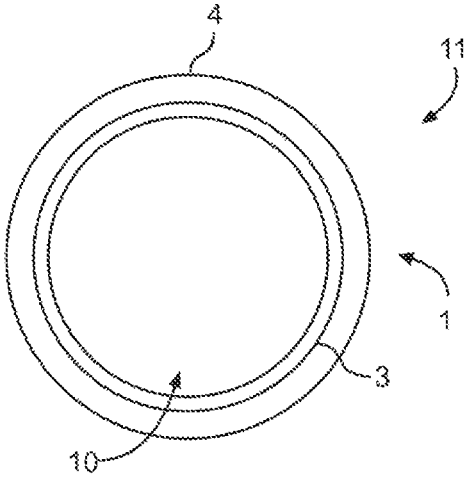
FIG. 9 is a top or bottom view of the column of the ball tee from FIG. 7, depicting a generally circular shape.
Figure 10:
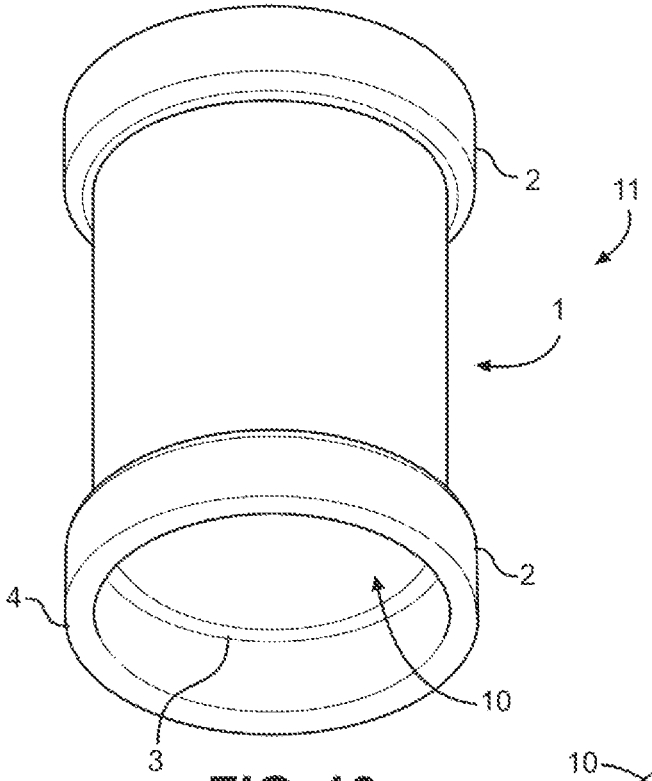
FIG. 10 is a perspective view of the column of the ball tee from FIG. 7.
Figure 11:
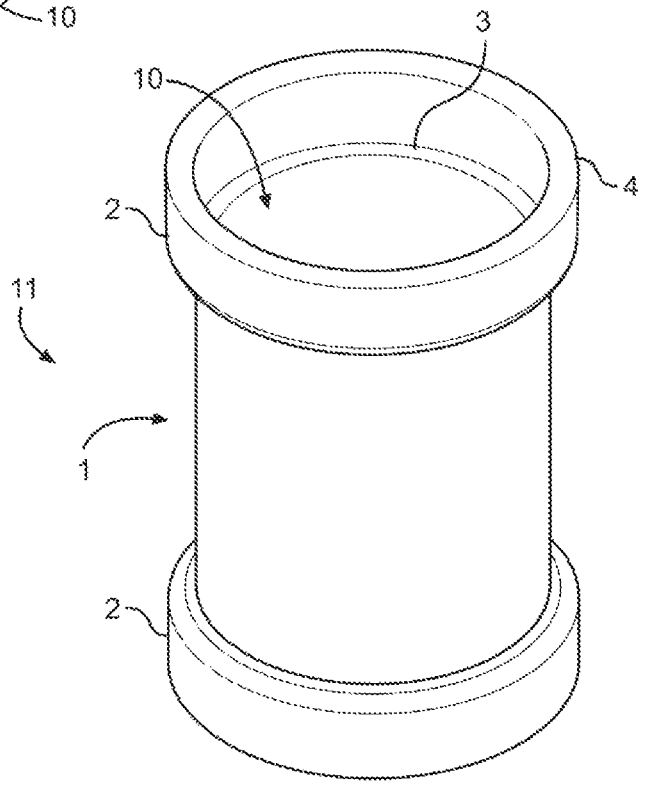
FIG. 11 is a perspective view of the column of the ball tee from FIG. 7.

FIG. 9 presents both a view from the top and a view from the bottom of the hollow column 1, and it should be appreciated that each end is dimensioned to be symmetrically identical. Each end is randomly determined to be the top or the bottom according to if it is situated up or down when erected vertically. From this top/bottom view of FIG. 9 we can see the progressive support ring (PSR) 4, the narrow end receiving stop (NERS) 3 on the inner wall of the narrow end receiving dock (N.E.R.D.) 4, and an aperture 10 through the center allowing an unobstructed view through the column 1. The apertures 10 may serve as finger holes and may contribute to the ease of transport of the ball tee 11, allowing many users to slip the ball tee 11 over their finger.

Figure 12:
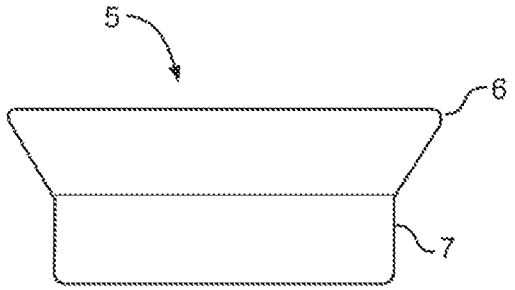
FIG. 12 is a front, back, or side view of a platform of the ball tee from FIG. 1.
Figure 13:
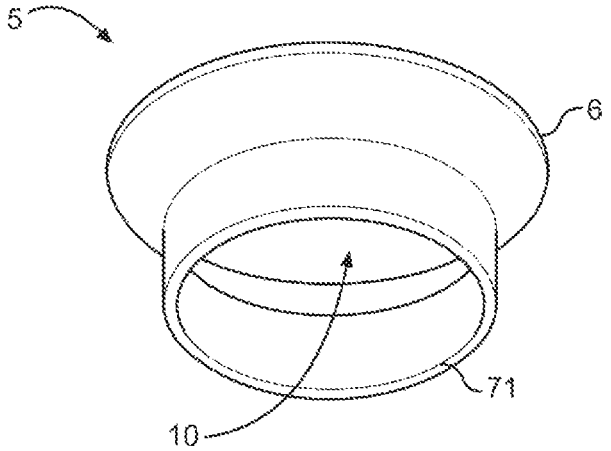
FIG. 13 is a perspective view of a platform of the ball tee from FIG. 12.
Figure 14:
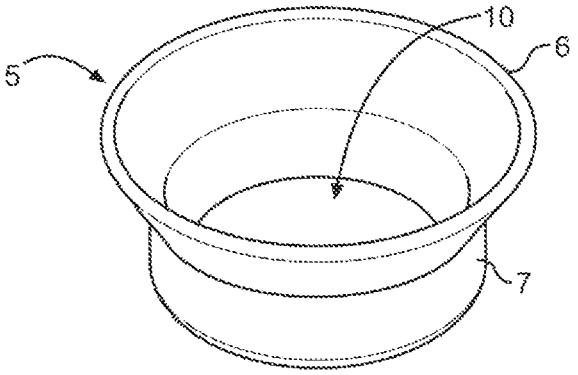
FIG. 14 is a perspective view of a platform of the ball tee from FIG. 12.

As best illustrated in FIGS. 12, 13, and 14, in embodiments of the invention, the platform 5 is a generally funnel-like shape, with a wide end 6 and a narrow end 7. The wide end 6 of a platform 5, when located on top of the ball tee, is oriented upward and slopes downward and inward presenting a general funnel-like shape and is dimensioned to hold a ball, providing greater stability to the ball than when no platform 5 is located on top end. The wide end 6 of the platform 5, when located on the bottom of the ball tee, is oriented downward and slopes upward and inward and interfaces with the surface on which it is placed, providing greater stability to the ball tee than when no platform 5 is located on the bottom. There is an aperture 10 through the center of the platform 5, allowing an unobstructed view through the platform 5. The aperture 10 may serve as a finger hole and may contribute to the ease of transport of the platform 5 itself, or the ball tee, when communicated to the ball tee, allowing many users to slip the ball tee over their finger.

Figure 15:
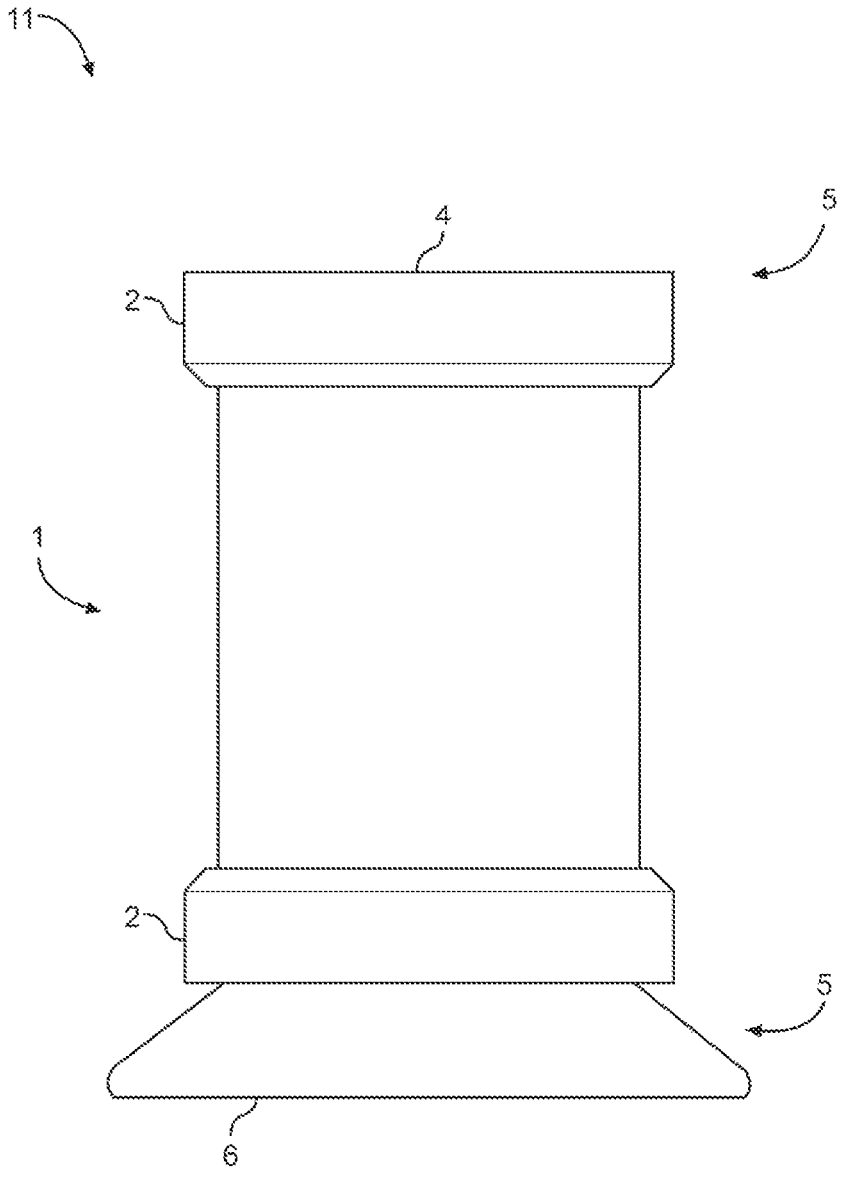
FIG. 15 is a front, back, or side view of an embodiment of the ball tee from FIG. 1.

As illustrated in FIGS. 1, 7, 15, and 16 on pages 9 and 10 of the drawings, in embodiments of the invention, there are four different configurations of the ball tee 11 offering increasing or decreasing levels of difficulty when utilizing the ball tee 11. When utilizing the ball tee 11, the object is to not have a ball fall to the ground or have the ball tee 11 fall over when placing a ball on, removing a ball from, or exchanging a ball on the ball tee 11. FIG. 1 presents the standard-level configuration for use of the ball tee 11, which is the novice level. This configuration is fully assembled with a column 1 featuring two narrow end receiving docks 2, and two platforms 5. FIG. 1 presents the configuration of the ball tee 11 with the greatest ease of use because the wide end 6 of the platform 5 at the top presents the greatest circumference in which a ball can rest, wide end 6 of the platform 5 at the bottom presents the greatest circumference available to stabilize the ball tee 11 on the surface on which it is erected. FIG. 15 is an intermediate-level configuration and presents a progression in difficulty of use compared to the ball tee 11 of FIG. 1. This intermediate level has a hollow column 1 featuring two narrow end receiving docks (N.E.R.D.) 2, a platform 5 communicated to the bottom of the column 1 and no platform communicated to the top, so a ball now must be placed on, removed from, or exchanged on the top progressive support ring (PSR) 4 which has a smaller circumference than a platform 5, presenting a less stable surface on which a ball may rest, requiring the user to focus more diligently and have greater dexterity to accomplish the goal.

Figure 7:
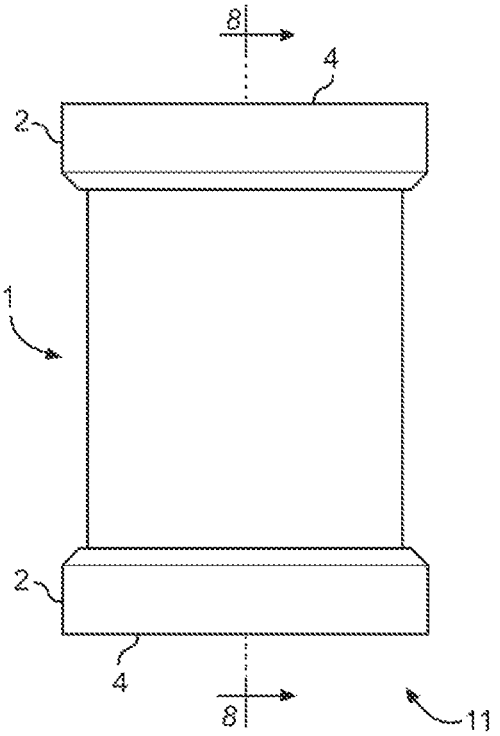
FIG. 7 is a front, back, or side view of the column of the ball tee.
Figure 8:
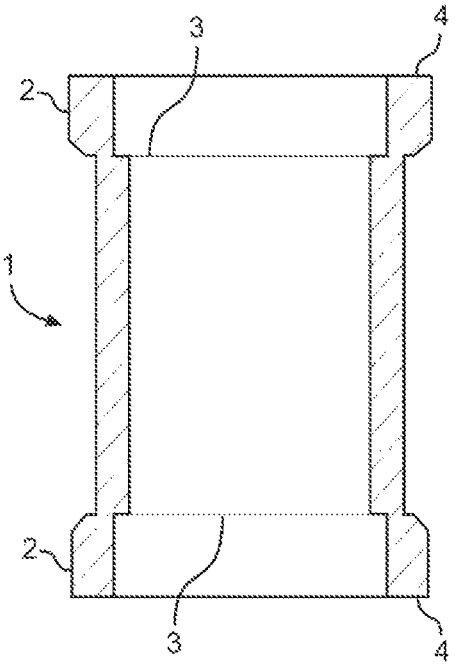
FIG. 8 is a vertical cross-section view of the column of the ball tee from FIG. 7, generally from a front, back, or side angle, taken along the vertical line between the two A's
Figure 16:
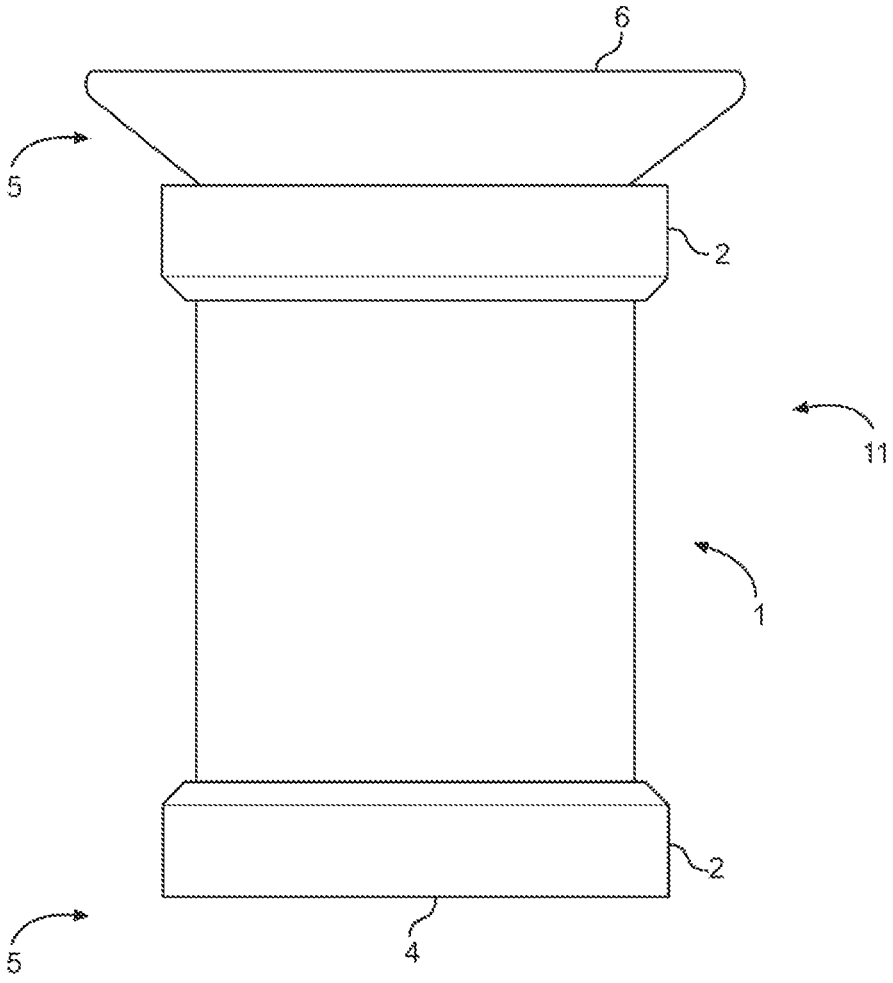
FIG. 16 is a front, back, or side view of an embodiment of the ball tee from FIG. 1.

FIG. 16 is another intermediate-level configuration and also presents a progression in difficulty of use compared to the ball tee 11 of FIG. 1. This intermediate level has a hollow column 1 featuring two narrow end receiving docks (N.E.R.D.) 2, a platform 5 communicated to the top of the column 1 and no platform communicated to the bottom, so the ball tee 11 must now stand on its bottom progressive support ring (PSR) 4 which has a smaller circumference than a platform 5 and causes greater instability on the surface on which the ball tee 11 is erected, increasing the likelihood it will fall over during use. This challenges the users to a greater degree. The user must now be even more steady with their hands, and steadier and more balanced throughout their knee bend process. This is made more difficult because the user may be taxed cardiovascular wise during the drills, causing the body to shake or tremble when trying to execute tasks with small precise movements. FIG. 7, is the advanced-level configuration and presents a progression in difficulty from the ball tees 11 of FIGS. 1, 15, and 16. This advanced-level configuration has just a hollow column 1 with no top or bottom platform. Now the ball tee 11 presents it smallest circumference at its top and bottom end, as the top and bottom progressive support rings (PSR) 4 assume the roles of ball holder and base, respectively. The reliance on the PSR's 4 in these roles, increases the likelihood the ball will fall off the ball tee 11 and/or the ball tee 11 will fall over during use. This may be the most challenging configuration for users.

Figure 17:
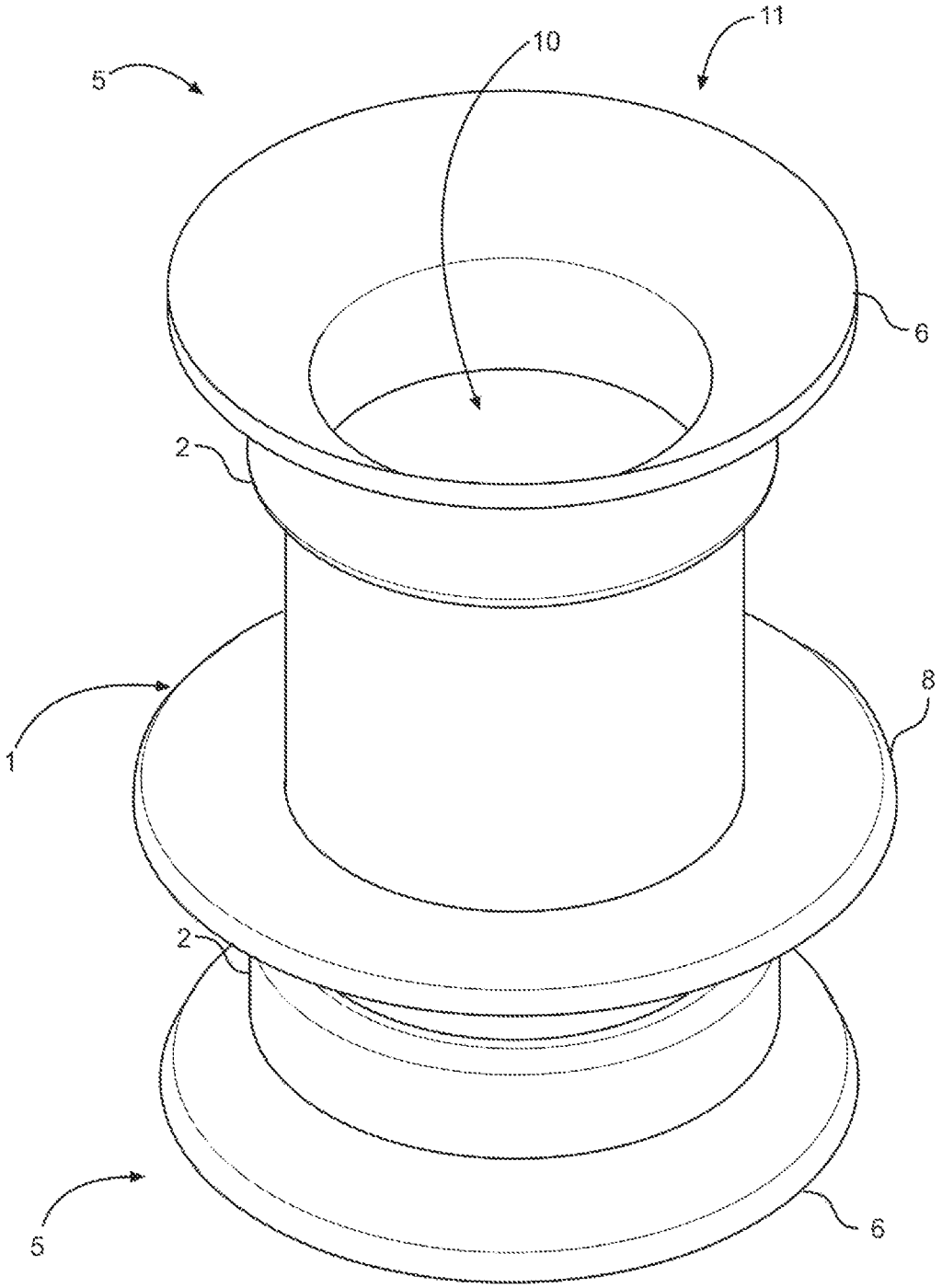
FIG. 17 is perspective view of an embodiment of the ball tee

As best illustrated in FIG. 17, in embodiments of the invention, the ball tee 11 comprises the hollow column 1 erected with either side up and the other side down, a platform 5 communicated to the top end of the column 1 and a platform 5 communicated to the bottom end of the column 1 via the narrow end receiving docks (N.E.R.D.) 2. The column 1 also features an external stabilizing ring 8 protruding from the column 1 and traveling 360° around the column 1. The stabilizing ring has a circumference greater than the circumference of the column 1. The stabilizing ring 8 allows the ball tee to be inserted into and remain upright in the aperture of an agility cone or utility cone, when use of the cones may be necessary on an uneven terrain or surface, or to elevate the ball tee 11. From this view the aperture is visible in the center of the top platform 5 and the column 1. The platform 5 located at the top of the column 1 serves as a ball holder, the platform 5 located at the bottom of the column serves as a base. When placed on the ball tee 11 in this configuration, a ball will rest on the wide end 6 of the top platform 5. The wide end 6 of the bottom platform 5 interfaces with ground or any other surface on which the ball tee 11 is erected. As represented in FIG. 1, It should be appreciated that the ball tee 11, when rotated 360°, presents the same view at every degree or rotation. In this regard, there are no obvious front, back, left, or right sides, so users may approach and utilize the ball tee 11 from any direction. It should also be appreciated that the embodiment of the ball tee 11 containing the stabilizing ring 8 may be assembled, disassembled, and configured for use in same manner as the ball tee with no stabilizing ring 8: with both platforms 5 communicated to the column 1; with one platform 5 communicated to the top of the column 1 and no platform 5 to the bottom; with one platform 5 communicated to the bottom of the column 1 and no platform 5 to the top; or the column 11 alone with neither a platform 5 communicated to the top of the column 1, nor a platform 5 communicated the bottom.

Figure 18:
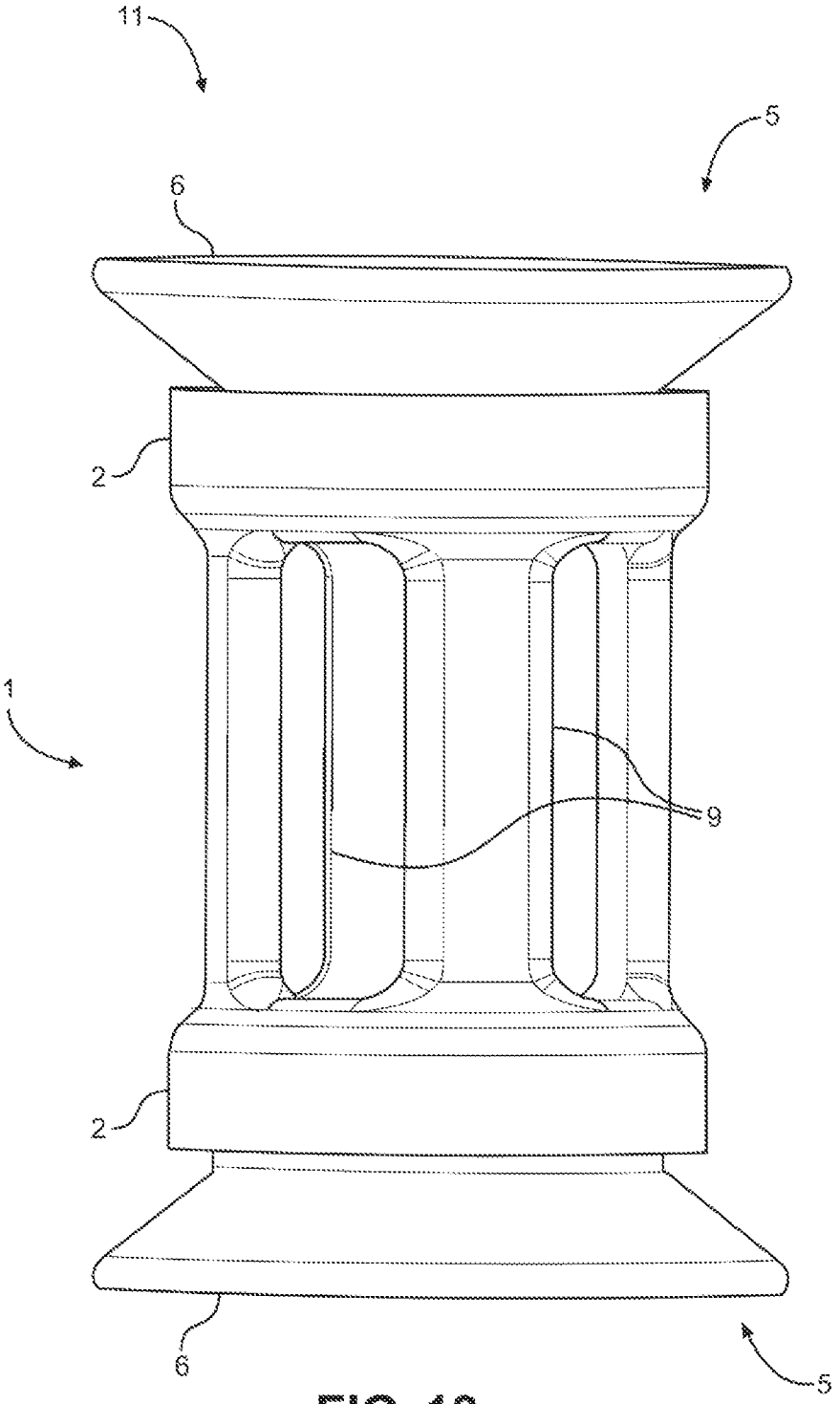
FIG. 18 is a front, back, or side view of an embodiment of the ball tee

As best illustrated in FIG. 18, in embodiments of the invention, the ball tee 11 comprises the hollow column 1 erected with either side up and the other side down, a platform 5 communicated to the top end of the column 1 and a platform 5 communicated to the bottom end of the column 1 via the narrow end receiving docks (N.E.R.D.) 2. The column 1 contains multiple wind vents 9 which allow wind to pass through the column, decreasing the chances the ball tee 11 will be toppled by wind when being used outdoors or anywhere subject to intense wind. The platform 5 located at the top of the column 1 serves as a ball holder, the platform 5 located at the bottom of the column serves as a base. When placed on the ball tee 11 in this configuration, a ball will rest on the wide end 6 of the top platform 5. The wide end 6 of the bottom platform 5 interfaces with ground or any other surface on which the ball tee 11 is erected. As represented in FIG. 18, It should be appreciated that the ball tee 11, when rotated 360°, presents the same view. In this regard, there are no obvious front, back, left, or right sides, so users may approach and utilize the ball tee 11 from any direction. It should also be appreciated that the embodiment of the ball tee 11 containing the wind vents 9 may be assembled, disassembled, and configured for use in same manner as the ball tee with no wind vents 9: with both platforms 5 communicated to the column 1; with one platform 5 communicated to the top of the column 1 and no platform 5 to the bottom; with one platform 5 communicated to the bottom of the column 1 and no platform 5 to the top; or the column 11 alone with neither a platform 5 communicated to the top of the column 1, nor a platform 5 communicated the bottom.

Besides its use as a new training tool, the ball tee 11 may also be utilized as an exciting sport or competition-like game, where users compete against one another individually or as teams, in athletic drills, cognitive drills, or cognitive-based athletic drills. The object is to complete the chosen drills as quickly as possible without having a ball fall from a ball tee 11 or having a ball tee 11 fall over. In essence, the ball tee 11 together with methods utilized to train for sports, easily functions as a sport, with the requisite attributes common to typical everyday sports.

When first utilizing the ball tee 11 to execute these cognitive-dependent, physically-demanding athletic drills, requiring the execution of small precise tasks, users will find that each of those factors will siphon from each other causing the user to be less effective in the overall performance of all the skills. After repeated training with the ball tee 11, the skill of thinking, reacting, and performing athletic maneuvers, all while being physically taxed, will become more achievable and may significantly improve athletic performance.

Because the ball tees can be erected on a table or desk, or any other object that brings the ball tee 11 higher, the invention can be utilized in a less physically demanding way for those limited in their physical mobility. This makes the ball tee 11 great for cognition and hand-eye coordination exercises in classrooms, meeting rooms, therapeutic and rehabilitation facilities, and a multitude of other environments that lack adequate space to run, or that cater to a less mobile population, or to those with delayed or degraded motor skills.

In embodiments of the invention, the ball tee 11 including the column 1 and the two platforms 5 are formed of polypropylene (PP), a thermoplastic polymer, injected into steel cavity molds Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The claimed invention is:

1. A multi-use ball tee, comprising:

a hollow column having an internal surface and an opposing external surface, the column extending along a central axis from a base opening to a platform opening, wherein the internal surface defines a first internal stop located at a first depth relative to the platform opening and a second internal stop located at a second depth relative to the base opening; and a pair of funnel-shaped removable platforms, each extending from a wide end to a neck that is sized and shaped to slidably engage with the internal surface of the hollow column and with either of the internal stops.

2. The ball of tee of claim 1, wherein the platform opening of the hollow column, without insertion therethrough of either of the pair of platforms, is sized and shaped to stably support a ball, and wherein the base opening of the hollow column, without insertion therethrough of either of the pair of platforms, is sized and shaped to stably support the ball tee.

3. The ball of tee of claim 1, wherein the first depth and the second depth are substantially equal to a common depth, and wherein the neck is sized in length to correlate with the common depth, such that each of the pair of platforms is interchangeable relative to the openings.

4. The ball tee of claim 1, wherein the wide end of each of the pair of platforms is sized and shaped, when inserted into the base opening, to stably support the ball tee, and when inserted into the platform opening, to stably support a ball.

5. The ball tee of claim 1, wherein the external surface of the hollow column at an intermediate location relative to the openings is characterized by an external radius relative to the central axis, the ball tee further comprising:

a first receiving dock located at the platform opening extending radially from the internal surface to a first external dock surface having a first dock radius that is greater than the external radius; and a second receiving dock located at the base opening extending radially from the internal surface to a second external dock surface having a second dock radius that is greater than the external radius.

6. The ball tee of claim 1, wherein the hollow column is sized in diameter for slidable insertion through an open end near the vertex of a cone-shaped support, and wherein the ball tee further comprises:

an external stabilizing ring extending radially from the external surface of the hollow column at an intermediate location relative to the openings, such that the ring is supported by the open end of the cone-shaped support.

7. The ball tee of claim 1, wherein the hollow column defines one or more vents therethrough.

* * * * *